US006844676B2

(12) United States Patent
Alderman et al.

(10) Patent No.: US 6,844,676 B2
(45) Date of Patent: Jan. 18, 2005

(54) CERAMIC HID LAMP WITH SPECIAL FRAME WIRE FOR STABILIZING THE ARC

(75) Inventors: John C. Alderman, Corning, NY (US); Shiming Wu, Painted Post, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/968,141

(22) Filed: Oct. 1, 2001

(65) Prior Publication Data

US 2003/0062831 A1 Apr. 3, 2003

(51) Int. Cl.[7] ..... H01J 61/06
(52) U.S. Cl. ..... 313/567; 313/607
(58) Field of Search ..... 313/567, 25, 573, 313/634, 607, 594–600, 24, 558

(56) References Cited

U.S. PATENT DOCUMENTS

| | | | | | |
|---|---|---|---|---|---|
| 2,152,997 | A | | 4/1939 | Johnson | 176/122 |
| 2,491,868 | A | | 12/1949 | Martt | |
| 2,930,920 | A | * | 3/1960 | Bird | 313/161 |
| 3,706,901 | A | * | 12/1972 | De Neve | 313/285 |
| 4,011,480 | A | | 3/1977 | Jacobs et al. | 313/217 |
| 4,134,039 | A | * | 1/1979 | Vida et al. | 313/640 |
| 4,249,102 | A | * | 2/1981 | Krieg et al. | 313/116 |
| 4,401,913 | A | * | 8/1983 | Koza et al. | 313/25 |
| 4,418,300 | A | * | 11/1983 | Otani et al. | 313/573 |
| 4,924,133 | A | * | 5/1990 | Dassler et al. | 313/25 |
| 4,950,938 | A | * | 8/1990 | Ramaiah | 313/25 |
| 5,055,735 | A | * | 10/1991 | De Jong et al. | 313/25 |
| 5,070,277 | A | * | 12/1991 | Lapatovich | 315/245 |
| 5,276,385 | A | * | 1/1994 | Itoh et al. | 315/73 |
| 5,402,033 | A | * | 3/1995 | van der Leeuw et al. | 313/25 |
| 5,406,165 | A | * | 4/1995 | Pragt | 313/25 |
| 5,453,654 | A | * | 9/1995 | Bastian et al. | 313/25 |
| 5,606,223 | A | | 2/1997 | Yamamoto et al. | 315/85 |
| 5,747,946 | A | * | 5/1998 | Tyler | 315/291 |
| 6,054,810 | A | * | 4/2000 | Yamamoto et al. | 313/607 |
| 6,069,456 | A | | 5/2000 | Fromm et al. | 315/248 |
| 6,713,961 | B2 | * | 3/2004 | Honda et al. | 313/607 |
| 6,741,013 | B2 | * | 5/2004 | Dakin et al. | 313/25 |

FOREIGN PATENT DOCUMENTS

| | | | | |
|---|---|---|---|---|
| EP | 0159620 | A2 | 10/1985 | H01J/61/12 |
| EP | 0186899 | A2 | 7/1986 | H01J/61/34 |
| EP | 0276514 | A1 | 8/1988 | H01J/61/18 |
| EP | 0732870 | A1 | 9/1996 | H05B/41/29 |
| EP | 0991097 | A1 | 4/2000 | H01J/61/073 |
| EP | 1215714 | A1 | 6/2002 | H01J/61/34 |
| GB | 489925 | A | 5/1938 | |
| GB | 2138629 | A | 10/1984 | H01J/61/02 |
| JP | 55-1059445 | | 8/1980 | H01J/61/50 |
| JP | 6372058 | * | 9/1986 | 61/50 |

OTHER PUBLICATIONS

Patent Abstracts of Japan, Fujiwara Mikihiro, "Metal Halide Lamp," Publication No. 02201860, Aug. 10, 1990, Application No. 01021441, Jan. 31, 1989.
Patent Abstracts of Japan, Yamazaki Haruo, "High Pressure Vapor Discharge Lamp," Publication No. 55105945, Aug. 14, 1980, Application No. 54013710, Feb. 7, 1979.
Patent Abstracts of Japan, Dobashi Masahiro, "Metal Halide Lamp," Publication No. 54091974, Jul. 20, 1979, Application No. 52160530, Dec. 28, 1977.

* cited by examiner

*Primary Examiner*—Joseph Williams
*Assistant Examiner*—Dalei Dong
(74) *Attorney, Agent, or Firm*—Dicran Halajian

(57) ABSTRACT

A high-pressure discharge lamp of the ceramic metal halide type having power ranges of about 150 W to about 1000 W. Such lamps have outer bulb enclosing a cylindrical ceramic discharge vessel enclosing a discharge space. The discharge vessel includes an ionizable material containing a metal halide; a first and second discharge electrode feedthrough; and a first and second current conductor connected to the first and second discharge electrode feedthrough, respectively. A frame wire structure includes at least one frame wire, connected to the current conductors, through a conductor. The frame wire structure extends between the ceramic discharge vessel and the glass bulb, and is effective to reduce arc bending, regardless of the orientation of the lamp during operation in a fixture and regardless of the relative position of the frame wire to the arc tube.

22 Claims, 7 Drawing Sheets

CERAMIC HID LAMP WITH SPECIAL FRAME WIRE FOR STABILIZING THE ARC

FIELD OF THE INVENTION

The invention relates to a high-pressure discharge lamp which is provided with a discharge vessel that encloses a discharge space and includes a ceramic wall, the discharge space accommodating a pair of electrodes and each electrode is connected to an electric current conductor by means of a leadthrough element. The invention also relates to a high intensity discharge (HID) lamp having a discharge vessel light source, a glass stem, a pair of leads embedded in the glass stem, a glass envelope surrounding the light source, and a wire frame member with a first end fixed with respect to the stem, an axial portion extending parallel to the axis of the lamp, and a second end resiliently fitted in the closed end of the glass envelope. FIG. 1 illustrates such a configuration.

BACKGROUND OF THE INVENTION

High intensity discharge (HID) lamps with translucent burners are well known in the art. The existing HID product rang consists of mercury vapor (MV), high pressure sodium (HPS), and quartz metal halide (MH) lamps. In recent years, ceramic metal halide lamps (for example, Philips MasterColor® Series) have entered the market place. Compared to the quartz MH lamps, the ceramic lamp have higher color consistency, better color rendering property, and higher lumen maintenance. The MasterColor® lamps are versatile light sources, since they can be mounted in either regular glass or quartz bulbs or in PAR reflectors. Existing Philips MasterColor® ceramic metal halide lamps include such lamps having a wattage of 39 W–150 W, also referred to as CDM lamps). Recently, the MasterColor® lamp series has been extended via work performed in our laboratory to higher wattages (up to 1000 W). These ceramic metal halide lamps display excellent initial. color consistency, superb stability over life (lumen maintenance >80%, color temperature shift >200 K at 10,000 hrs), high luminous efficacy of >90 lumens/watt, color rendering index (CRI) of >90 and lifetime of about 20,000 hours. These highly desirable characteristics are due to the high stability of the polycrystalline alumina (PCA) envelopes and a special mixture of salts, which emits a continuous-spectrum light radiation close to natural light and other parameters that have been identified and developed.

One current design of high wattage MasterColor® lamps utilizes a cylindrical PCA discharge tube with extended plugs for securing electrodes. The approximate range of aspect ratio of the PCA discharge tube, i.e. length/diameter, of the PCA body is about 3 to 10, with the distance between two electrodes ranging from 10 mm to 60 mm. For the top of the line 400 W and 1000 W lamps, the amp current is approximately 4.5 A (ANSI standard) in steady state operation and is approximately 7–8 A during warm up. The mount structure of the high wattage MasterColor® lamps include a standard glass bulb with gas filling or vacuum, stem, connectors, getters, current carrying frame wire, and ignition aids such as UV enhancer or antenna. In the current design, a single straight frame wire is mounted on the stem, and is similar to most HPS lamp constructions. The distance between the frame wire and arc tube surface is about 15 mm.

The large current carried by the frame wire generates an AC magnetic field. The magnetic field interacts with the electrons and ions of the plasma stream. We have observed that the magnetic force is strong enough to interact with the plasma stream and results in arc bending. In vertical orientation as shown in FIG. 2, the magnetic field pushes the plasma stream away from the axis of the arc tube. The maximum working temperature of the PCA surface should not exceed 1250° C. Otherwise the surface would be damaged. The curving arc, which creates a much higher local surface temperature on the opposite side of the frame wire, would result in a PCA damage or even cracks in a short period of time. In horizontal orientation, as shown in FIG. 3, the arc is naturally off-center toward the upper surface, because of the heat convection surrounding the arc tube. Placing the frame wire on the top of the arc tube would center the arc, because of the canceled forces of the heat convection and the magnetic field. However, if the frame wire were placed underneath the arc tube, the combined forces of heat convection and magnetic field would result in a more severely bent arc. With such an orientational dependence, a ceramic metal halide lamp with a straight frame wire may not be used as a universal lamp. From past experience, it is cost-prohibitive to produce special-based lamps and fixture sockets to ensure every horizontal burning lamp is mounted with the frame wire on the top of the arc tube.

U.S. Pat. No. 2,930,920, discloses an electric discharge lamp that utilizes a quartz glass discharge tube of spherical shape and of such dimensions that the lamp operates at temperatures of about 800° C. to 1000° C. In such lamp construction, the electrodes are arranged very close to each other and the arc tube is spherical and very short, i.e. the length of the arc varied from a few tenths of a millimeter to several millimeters. This translates to an aspect ratio of about 1.0. In such lamps also the electrodes are said to deteriorate under operating pressures as a result of wandering arc discharge and bowing of the discharge which is disclosed to be mitigated by various frame wire arrangements in which input leads are so connected to the frame and the frame to one of the electrodes so that the current is effectively divided to provide equal current distribution on both sides of the arc, whereby the magnetic fields associated with the sides of the frame effectively counteract each other. The compact arc, mercury vapor type lamp disclosed with a relatively short, spherical, thick wall quartz arc tube and electrodes closely spaced together, is largely obsolete by today's standard. The HID ceramic metal halide lamps of the type under consideration in this invention have excellent initial color consistency, superb stability over life (lumen maintenance >80%, color temperature shift <200 K at 10,000 hrs), high luminous efficacy of >90 lumens/watt (vs. 50–70 lumens/watt of the quartz lamps), high color rendering index (CRI) of >90 (vs. CRI<40 of the mercury vapor lamps) and a lifetime of about 20,000 hours (no deterioration of electrodes). These highly desirable characteristics are due to the high stability of the polycrystalline alumina (PCA) envelopes and a special mixture of salts, which emits a continuous-spectrum light radiation close to natural light, and other parameters that have been identified and developed in our research facilities.

U.S. Pat. No. 5,606,223 discloses a luminaire in which any noise occurring due to generation of a magnetic field is reduced through use of a structure wherein a lamp is connected at one electrode to an ordinary current loop and at the other electrode to another current loop which is branched into more than two which are extending along opposite sides of the lamp. Ceramic metal halide lamps are not disclosed.

Great Britain Patent Application 2,138,629A relates to high frequency gas discharge lamps with a gas discharge tube arranged so that at least two current-providing loops are formed whose resulting magnetic moment oppose and tend to cancel each other out, thereby reducing radio-frequency noise. Attempts in our laboratory to use high frequency ballasts to operate high wattage ceramic metal halide lamps were unsuccessful, either because they did not exhibit good lighting properties and exhibited low output, color separation, or displayed an unstable arc.

There is a need in the art for HID lamps of the ceramic metal halide type with power ranges of about 150 W to about 1000 W, and for such lamps in which the arc bending problem is eliminated or at least minimized, regardless of the orientation of the lamp in the fixture and regardless of the relative position of the frame wire to the arc tube.

SUMMARY OF THE INVENTION

An object of the invention is to provide HID lamps of the ceramic metal halide type with power ranges of about 150 W to about 1000 W in which the arc bending problem is eliminated or at least minimized. The nominal voltage, as specified by applicable ANSI standards for HPS and MH varies from 100 V to 135 V for 150 W to 400 W lamps and then increases with the rated power to about 260 V for 1000 W lamps.

Another object of the invention is to provide ceramic metal halide lamps of the Philips MasterColor® series that display excellent initial color consistency, superb stability over life (lumen maintenance >80%, color temperature shift <200 K at 10,000 hrs), high luminous efficacy of >90 lumens/watt, high color rendering index of >90, a lifetime of about 20,000 hours, and power ranges of about 150 W to about 1000 W, and in which the arc bending problem is eliminated or at least minimized, regardless of the orientation of the lamp in the fixture and regardless of the relative position of the frame wire to the arc tube.

Another object of the invention is to provide ceramic metal halide lamps having a power range of about 150 W to about 1000 W and exhibiting one or more of a characteristic selected from the group consisting of a CCT (correlated color temperature) of about 3800 to about 4500 K, a CRI (color rendering index) of about 70 to about 95, a MPCD (mean perceptible color difference) of about ±10, a luminous efficacy up to about 85–95 lumens/watt, in which the arc bending problem is eliminated or at least minimized, regardless of the orientation of the lamp in the fixture and regardless of the relative position of the frame wire to the arc tube.

These and other objects of the invention are accomplished, according to a preferred embodiment of the invention in which the straight frame wire structure commonly used in HPS lamps is replaced with one of the following:

(1) at least two and preferably two straight frame wires, and utilized in ceramic metal halide lamps. Preferably, a wire frame structure is used in which identical straight frame wires extend adjacent and parallel on at least two sides of the arc tube. Preferably also the distance between the arc and each wire is equal. Placing the wires to extend parallel to and adjacent at least two sides of and equidistant to the arc tube is believed to cancel the magnetic force acting on the arc. The current is carried by at least two wires at half of the intensity and the magnetic field applied on the arc is cancelled out if the distances between the arc and the wires are equal. The mount structure requires no more space than the single frame wire structure commonly used in HPS lamps with a ED18 bulb, therefore the arc tubes can be mounted in elongated shaped standard glass bulbs such as ED18 illustrated in FIG. 1. This structure is suitable for lamps requiring a compact outer bulb. The cancellation of the magnetic field in turn prevents arc bending and consequent heating of the PCA surface near the bent arc, regardless of the orientation of the lamp in the fixture and regardless of the relative position of the frame wire to the arc tube. This leads to improved life of the lamp.

(2) at least two and preferably two spirally curved frame wires, and utilized in ceramic metal halide lamps. Preferably, a wire frame structure is used in which two identical spirally curved frame wires extend adjacent on two sides of the arc tube. Preferably also the distance between the arc and each wire is equal. Placing the arc tube in the common center of the two equally spaced spiral wires is believed to cancel the magnetic force acting on the arc. The current is carried by at least two wires at half of the intensity and the magnetic field applied on the arc is cancelled out if the distances between the arc and the wires are equal. The mount structure requires no more space than the single frame wire structure commonly used in HPS lamps with a ED18 bulb, therefore the arc tubes can be mounted in elongated shaped standard glass bulbs such as ED18. This structure is suitable for lamps requiring a compact outer bulb. The cancellation of the magnetic field in turn prevents arc bending and consequent heating of the PCA surface near the bent arc, regardless of the orientation of the lamp in the fixture and regardless of the relative position of the frame wire to the arc tube. This leads to improved life of the lamp.

(3) at least one and preferably one spirally curved frame wire, and utilized in ceramic metal halide lamps. Preferably, a wire frame structure is used in which spirally curved frame wire extends on sides of the arc tube. Preferably also the distance between the center of the arc to the spiral is equal in all directions. Placing the spirally curved wires to extend to the arc tube is believed to alter the direction of the magnetic field to parallel to the arc. The current is carried by the spirally curved wire and the magnetic force applied on the arc is zero. The mount structure requires no more space than the single frame wire structure commonly used in HPS lamps with a ED18 bulb, therefore the arc tubes can be mounted in elongated shaped standard glass bulbs such as ED18. This structure is suitable for lamps requiring a compact outer bulb. The cancellation of the magnetic field in turn prevents arc bending and consequent heating of the PCA surface near the bent arc, regardless of the orientation of the lamp in the fixture and regardless of the relative position of the frame wire to the arc tube. This leads to improved life of the lamp.

In preferred embodiments of the invention, the lamps will exhibit one or more of the common characteristics of higher wattage MasterColor® lamps: excellent initial color consistency; and/or superb stability over life (lumen maintenance >80%, color temperature shift <200 K at 10,000 hrs); and/or high luminous efficacy of >90 lumens/watt; and/or color rendering index (CRI) of >90; and/or a lifetime of about 20,000 hours; and/or power ranges of about 150 W to about 1000 W; and in each instance, will employ at least one of the preferred embodiments of the invention, i.e. a curved frame wire as illustrated and described which extends adjacent the glass bulb and is effective to at least minimize arc bending when the lamp is operated; and/or lamps are provided having a power range of about 150 W to about 1000 W and exhibiting one or more of a characteristic selected from the group consisting of a CCT (correlated color temperature) of about 3800 to about 4500 K, a CRI (color rendering index) of about 85 to about 95, a MPCD (mean perceptible color difference) of about ±10, a luminous efficacy up to about 85–95 lumens/watt, in which the arc bending problem is eliminated or at least minimized, regardless of the orientation of the lamp in the fixture and regardless of the relative position of the frame wire to the arc tube.

BRIEF DESCRIPTION OF THE DRAWING

The above aspects and further aspects of the lamps in accordance with the invention will be described in detail hereinafter with reference to the drawing in which.

The invention will be better understood with reference to the details of specific embodiments that follow:

DETAILED DESCRIPTION OF THE PREFERRED EMBODIMENTS

Preferred Embodiment (1)

Figure 1:
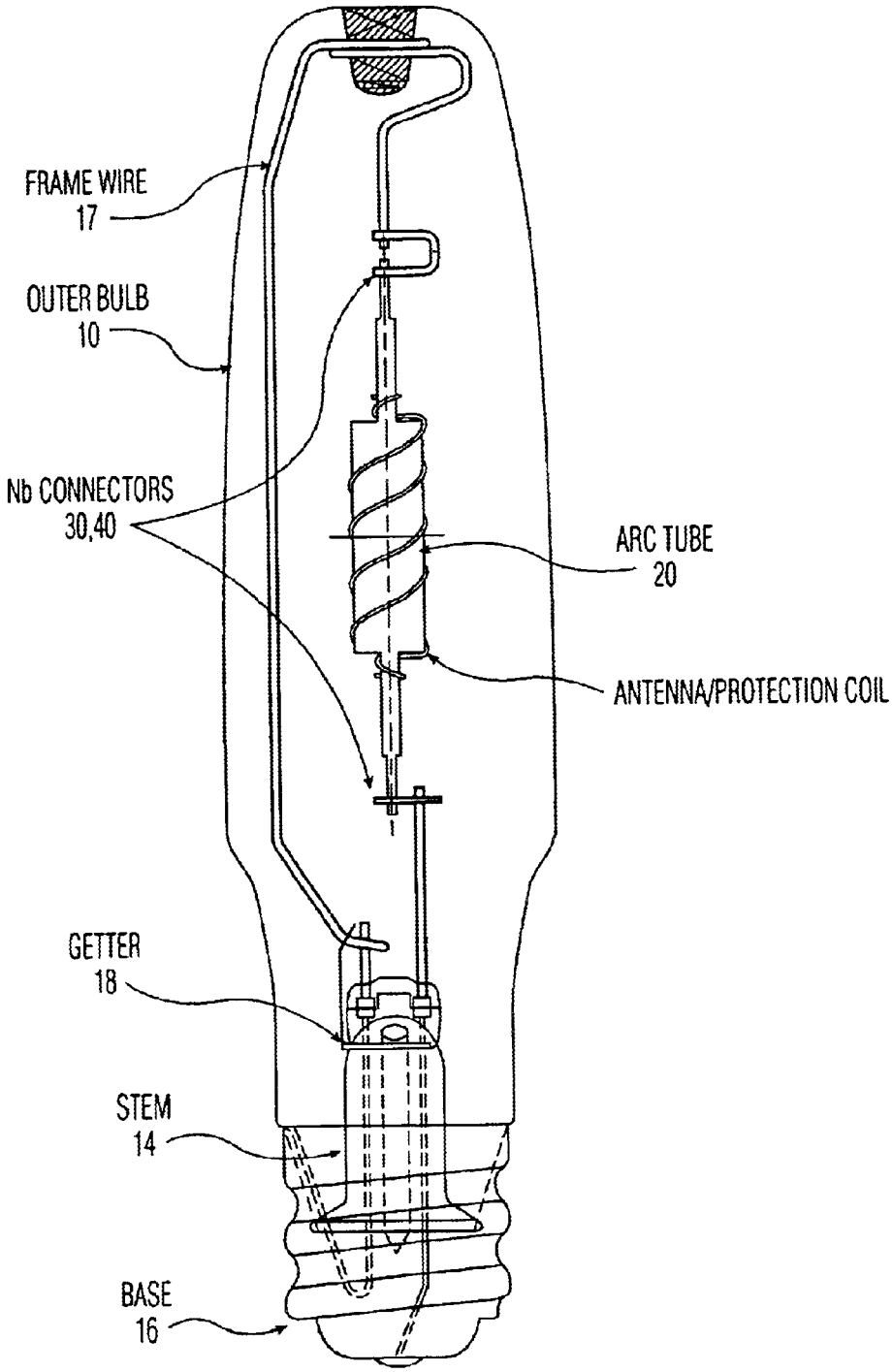
FIG. 1 is a schematic of a lamp having a frame wire configuration that is not in accordance with the invention.
Figure 2A:
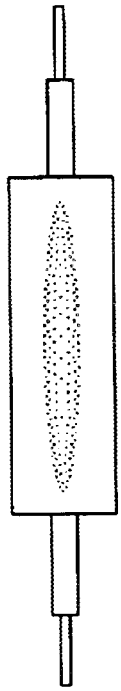
FIG. 2 is a schematic illustration of the interaction between the magnet field of the straight frame wire of a lamp of the FIG. 1 configuration and the arc in the discharge vessel when the lamp and arc tube is placed vertically in the fixture.
Figure 2B:
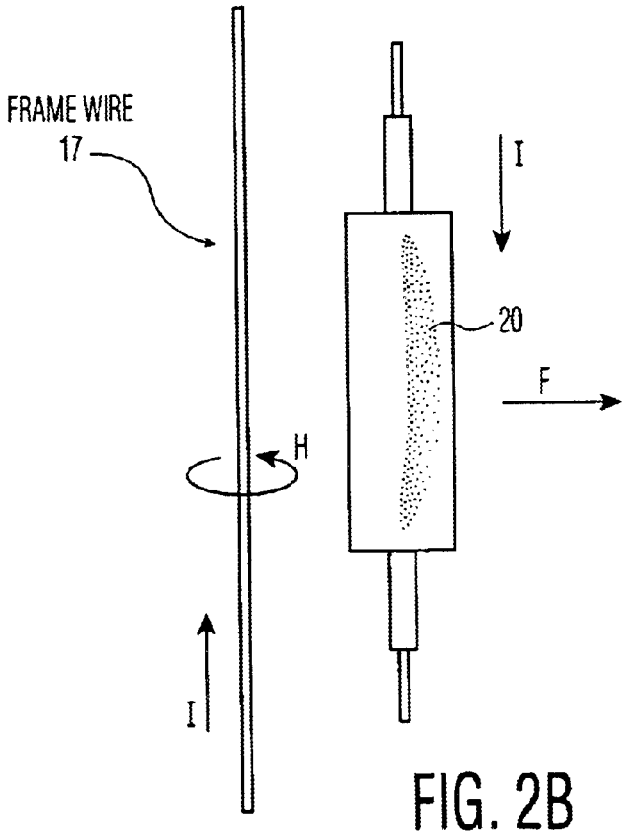
Figure 3A:
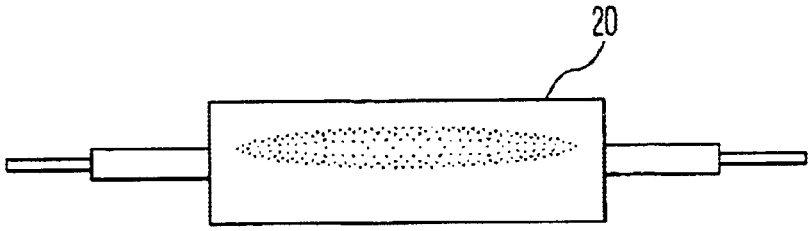
FIG. 3 is a schematic illustration of the interaction between the magnet field of the straight frame wire of a lamp of the FIG. 1 configuration and the arc in the discharge vessel when the lamp and arc tube is placed horizontally in the fixture.
Figure 3B:
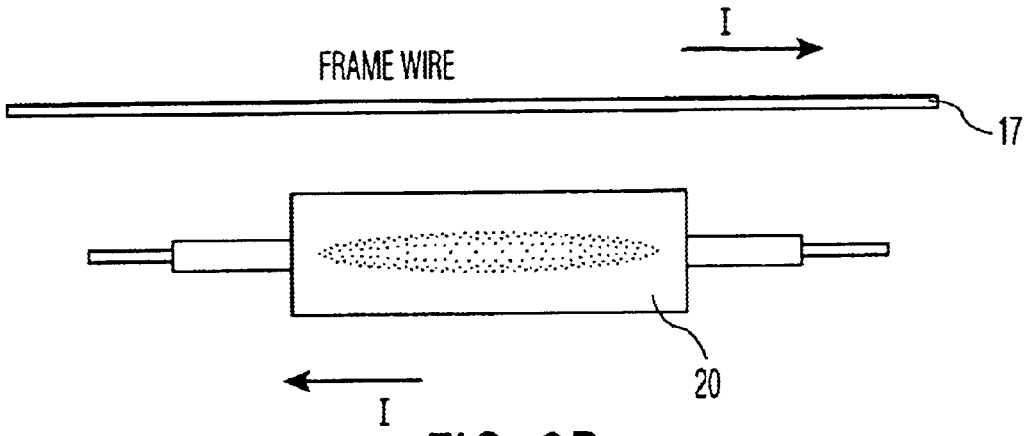
Figure 3C:
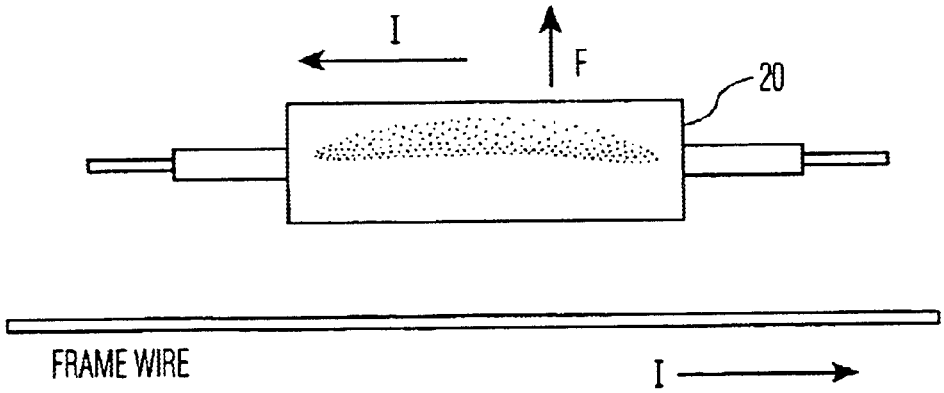
Figure 4:
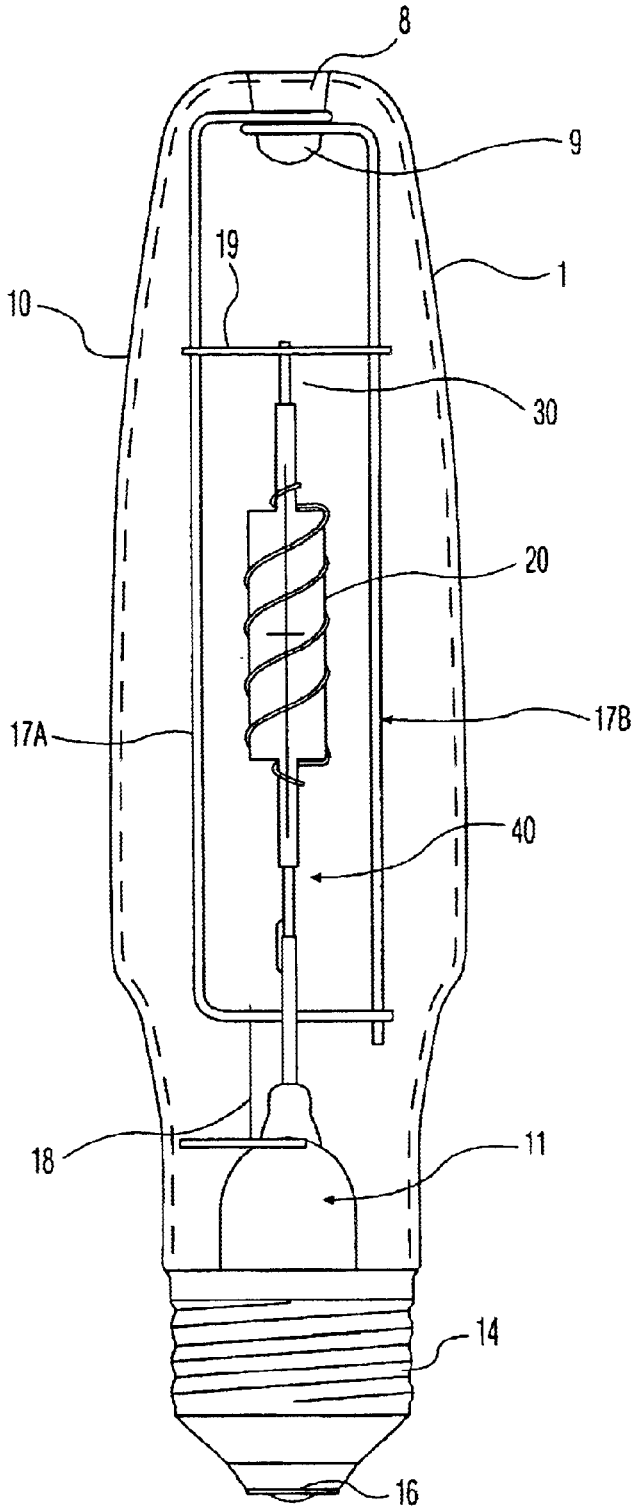
FIG. 4 is a schematic of a lamp according to the preferred embodiment (1) of the invention.
Figure 5:
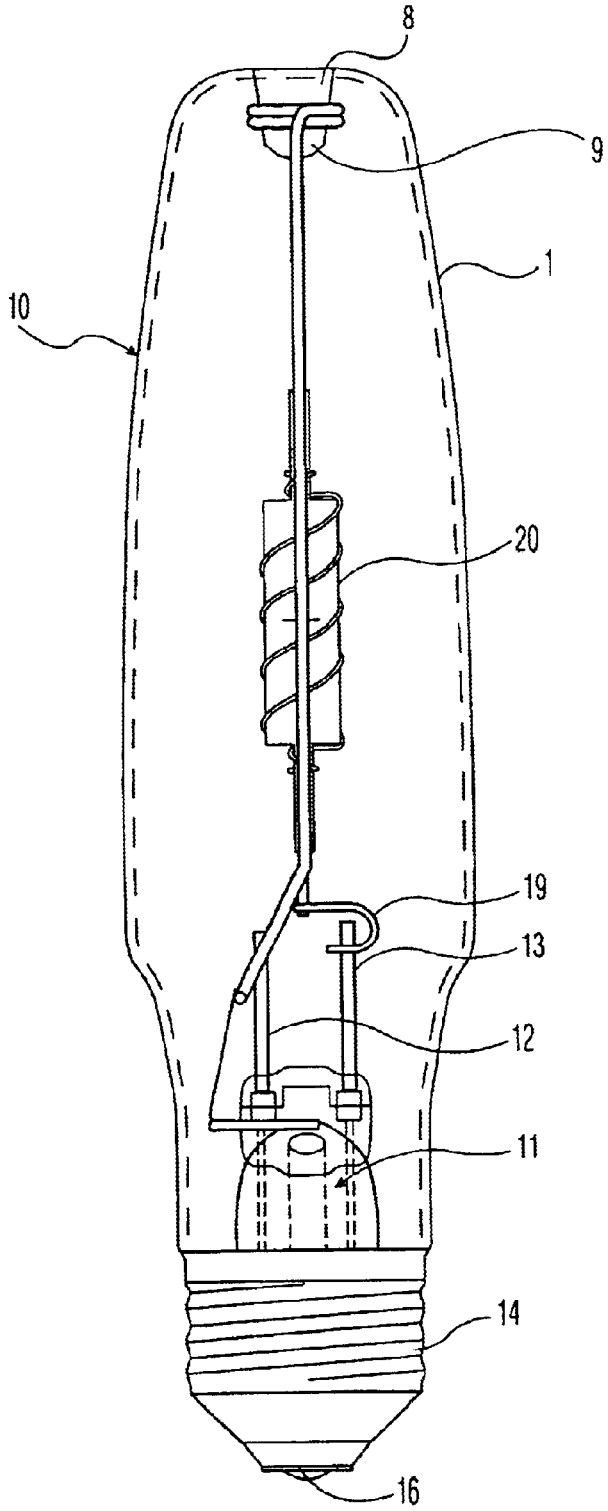
FIG. 5 is a side view of the lamp of FIG. 4.

Referring to FIGS. 4 and 5, a ceramic metal halide discharge lamp 1 comprises a glass outer envelope 10, a glass stem 11 having a pair of conductive stem leads 12, 13 embedded therein, a metal base 14, and a center contact 16 which is insulated from the base 14. The stem leads 12, 13 are connected to the base 14 and center contact 16, respectively, and not only support an arc tube 20, but also supply current to the electrode feedthroughs 30, 40 via frame wire members 17A and 17B and stem lead member 13. A getter 18 is fixed to either or both of the frame members 17A and 17B. Connectors 19, preferably niobium connectors, provide an electrical connection for the arc tube electrode feedthroughs 30 and 40. Beyond this the frame members 17A and 17B are provided with an end portion 9 that contacts a dimple 8 formed in the upper axial end of the glass envelope 10.

In this embodiment of the invention, by using two identical frame wires that are parallel to the arc and wherein the distance between the arc and each wire is equal, arc bending is eliminated. Placing the two wires in parallel on either side of and equidistant to the arc tube is believed to cancel the magnetic force acting on the arc. The current is carried by both wires at half of the intensity and the magnetic field applied on the arc is cancelled out with the effect that detrimental interaction between the frame wire and the arc is greatly reduced and in some cases eliminated. For example, no arc bending was observed in vertical burning condition at up to 714 W of power and 8.13 amps of AC current on a nominal 400 W lamp. Additionally, in horizontal burning condition, the arc was slightly off center but not bent, i.e., no arc bending caused by the frame-arc interaction was observed.

The arc tube 20 is formed as a ceramic tube preferably having disc-like end walls with central apertures which receive end plugs. Preferably, the end plugs are also formed as ceramic tubes, and receive electrodes 30, 40 therethrough. The electrodes feedthroughs 30, 40 each have a lead-in, preferably of niobium which is sealed with a frit which hermetically seals the electrode assembly into the PCA arc tube. The barrel and end walls enclose a discharge space containing an ionizable filling of an inert gas, a mixture of several metal halides, and mercury.

As used herein with respect all embodiments of the invention, "ceramic" means a refractory material such as a monocrystalline metal oxide (e.g. sapphire), polycrystalline metal oxide (e.g. polycrystalline densely sintered aluminum oxide and yttrium oxide), and polycrystalline non-oxide material (e.g. aluminum nitride). Such materials allow for wall temperatures of 1500–1600 K and resist chemical attacks by halides and Na. For purposes of the present invention, polycrystalline aluminum oxide (PCA) has been found to be most suitable.

Preferred Embodiment (2)

Figure 6:
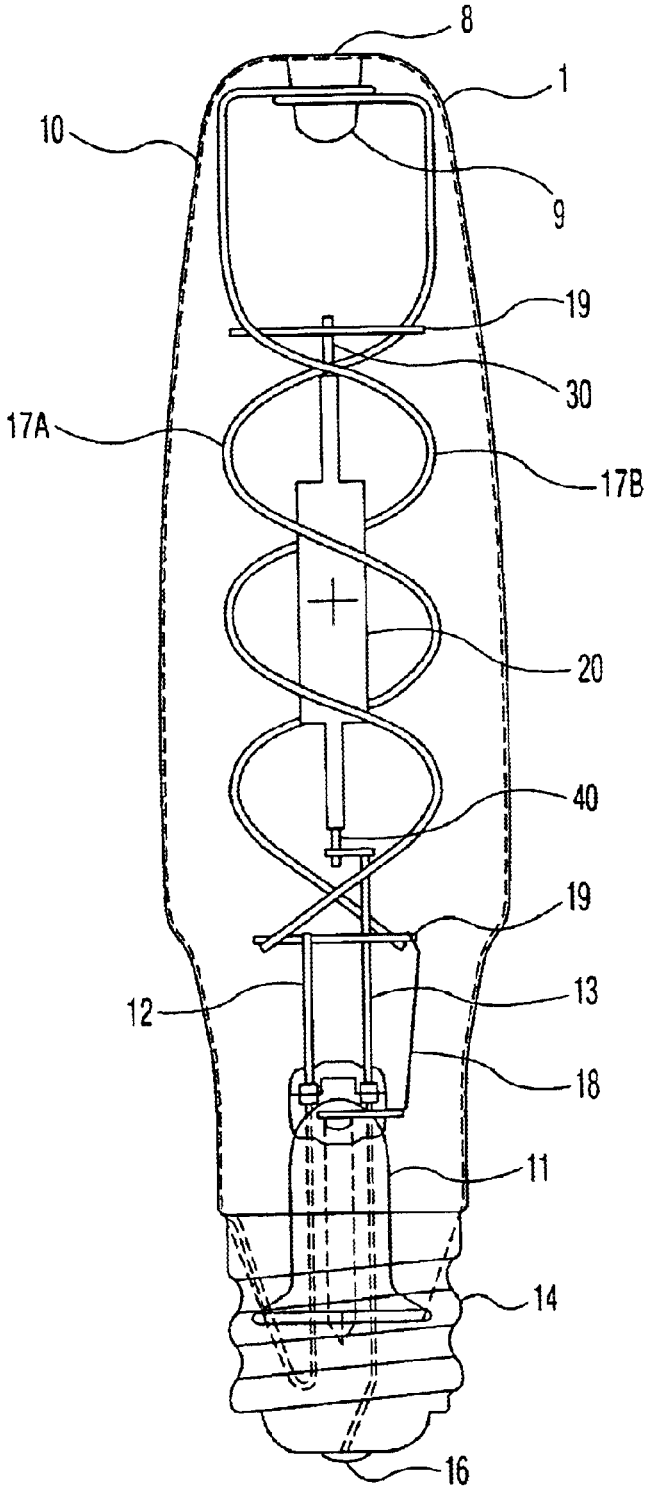
FIG. 6 is a schematic of a lamp according to the preferred embodiment (2) of the invention.

Referring to FIG. 6, a ceramic metal halide discharge lamp 1 comprises a glass outer envelope 10, a glass stem 11 having a pair of conductive stem leads 12, 13 embedded therein, a metal base 14, and a center contact 16 which is insulated from the base 14. The stem leads 12, 13 are connected to the base 14 and center contact 16, respectively, and not only support an arc tube 20, but also supply current to the electrode feedthroughs 30, 40 via frame wire members 17A and 17B and stem lead member 13. A getter 18 is fixed to either or both of the frame members 17A and 17B. Connectors 19, preferably niobium connectors, provide an electrical connection for the arc tube electrode feedthroughs 30 and 40. Beyond this the frame members 17A and 17B are provided with an end portion 9 that contacts a dimple 8 formed in the upper axial end of the glass envelope 10.

In this embodiment of the invention, two spirally curved frame wires 17A and 17B are placed symmetrically to the axis of the arc tube. The distance between the arc and each of the wires is equal. Placing the arc tube in the common center of the two equally spaced spiral wires is believed to cancel the magnetic force acting on the arc. The current is carried by the two wires at half of the intensity, and the magnetic field applied on the arc is cancelled out if the distances between the arc and the wires are equal. The cancellation of the magnetic field in turn prevents arc bending and consequent heating of the PCA surface near the bent arc, regardless of the orientation of the lamp in the fixture and regardless of the relative position of the frame wire to the arc tube. This leads to improved life of the lamp. For example, no arc bending was observed in vertical burning position at up to 600 W of power and 7 amps of AC current on a nominal 400 W lamp.

The arc tube 20 is formed as a ceramic tube preferably having disc-like end walls with central apertures which receive end plugs. Preferably, the end plugs are also formed as ceramic tubes, and receive electrodes 30, 40 therethrough. The electrode feedthroughs 30, 40 each have a lead-in, preferably of niobium which is sealed with a frit which hermetically seals the electrode assembly into the PCA arc tube. The barrel and end walls enclose a discharge space containing an ionizable filling of an inert gas, a mixture of several metal halides, and mercury.

Preferred Embodiment (3)

Figure 7:
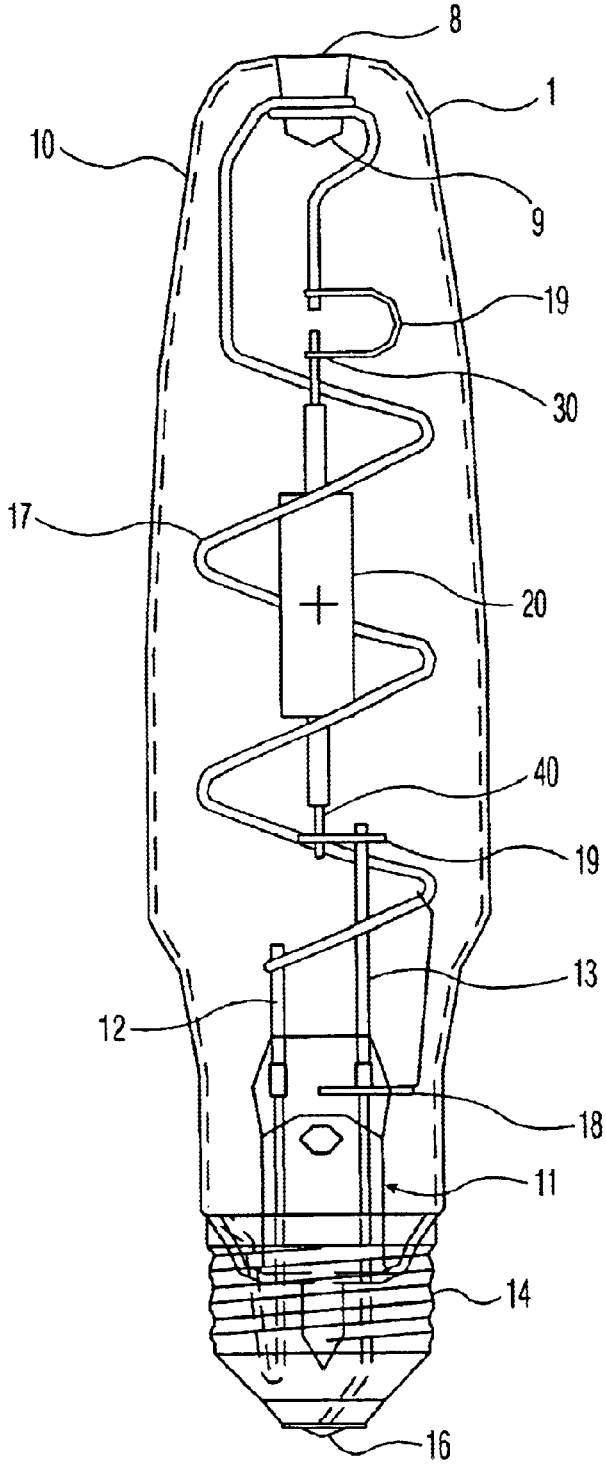
FIG. 7 is a schematic of a lamp according to the preferred embodiment (3) of the invention.

Referring to FIG. 7, a ceramic metal halide discharge lamp 1 comprises a glass outer envelope 10, a glass stem 11 having a pair of conductive stem leads 12, 13 embedded therein, a metal base 14, and a center contact 16 which is insulated from the base 14. The stem leads 12, 13 are connected to the base 14 and center contact 16, respectively, and not only support an arc tube 20, but also supply current to the electrode feedthroughs 30, 40 via frame wire member 17 and stem lead member 13. A getter 18 is fixed to the frame member 17. Connectors 19, preferably niobium connectors, provide an electrical connection for the arc tube electrode feedthroughs 30 and 40. Beyond this the frame member 17 is provided with an end portion 9 that contacts a dimple 8 formed in the upper axial end of the glass envelope 10.

In this embodiment of the invention, a spirally curved frame wire is used in which the spirally curved frame wire extends on sides of the arc tube. The distance between the center of the arc to the spiral is equal in all directions The direction of the AC magnetic field carried by the frame is altered by the spiral to parallel to the axis of the arc tube. Hence, the magnetic force applied on the arc is zero. The detrimental interaction between the frame wire and the arc is greatly reduced and in some cases eliminated. For example, no arc bending was observed in vertical burning condition at up to 714 W of power and 8.13 amps of AC current on a nominal 400 W lamp. Additionally, in horizontal burning condition, the arc was slightly off center but not bent, i.e., no arc bending caused by the frame-arc interaction was observed.

The arc tube 20 is formed as a ceramic tube preferably having disc-like end walls with central apertures which receive end plugs. Preferably, the end plugs are also formed as ceramic tubes, and receive electrodes 30, 40 therethrough. The electrode feedthroughs 30, 40 each have a lead-in, preferably of niobium which is sealed with a frit which hermetically seals the electrode assembly into the PCA arc tube. The barrel and end walls enclose a discharge space containing an ionizable filling of an inert gas, a mixture of several metal halides, and mercury.

Thus to summarize, there is provided high wattage discharge lamps which comprise a ceramic discharge vessel which encloses a discharge space and is provided with preferably a cylindrical-shaped ceramic, preferably a sintered translucent polycrystalline alumina, arc tube with electrodes, preferably tungsten-molybdenum-cermet-niobium electrodes or tungsten-cermet-niobium electrodes, attached on either side by gas-tight seals. Metallic mercury, a mixture of noble gases and, optionally, radioactive $^{85}$Kr, and a salt mixture such as a mixture composed of sodium iodide, calcium iodide, thallium iodide and several rare earth iodides are contained in the arc tube. The entire arc tube and its supporting structure are enclosed in a standard-size lead-free hard glass bulb, and further comprises frame wire(s) that are effective to mitigate or substantially reduce or eliminate arc bending in the lamp.

It will be understood that the invention may be embodied in other specific forms without departing from the spirit and scope or essential characteristics thereof, the present disclosed examples being only preferred embodiments thereof.

We claim:

1. A discharge lamp comprising an outer bulb enclosing a single discharge vessel, said single discharge vessel enclosing an arc discharge space and including within said discharge space an ionizable material comprising a metal halide and capable of sustaining an arc; a first and second discharge electrode feedthrough means; and a first and second current conductor connected to said first and second discharge electrode feedthrough means, respectively;

said lamp having a frame wire structure which comprises two frame wires being spirally curved around said single discharge vessel in a direction oriented substantially parallel to the longitudinal axis of said single discharge vessel, wherein the distance between the single discharge vessel and each of said two frame wires is substantially equal, wherein each of said two frame wires conducts one-half of a total current supplied to said single discharge vessel, and wherein said two frame wires are connected to respective ones is of said first and second current conductors, extending between said single discharge vessel and said outer bulb, and effective to reduce arc bending, regardless of the orientation of the lamp during operation in a fixture.

2. A lamp as claimed in claim 1, wherein said two frame wires spirally curve with at least one revolution.

3. A lamp as claimed in claim 2, wherein the distance between the discharge vessel and each wire is substantially equal.

4. A lamp as claimed in claim 2, having a power range of about 150 W to about 1000 W and exhibiting one or more of a characteristic selected from the group consisting of a CCT (correlated color temperature) of about 3800 to about 4500K, a CRI (color rendering index) of about 85 to about 95, a MPCD (mean perceptible color difference) of about ±10, and a luminous efficacy up to about 85–95 lumens/watt.

5. A lamp as claimed in claim 1, further comprising ballasts designed for high pressure sodium or quartz metal halide lamps.

6. A discharge lamp as claimed in claim 1, wherein said two frame wires commonly contact a dimple formed in the upper axial end of the single discharge vessel.

7. A discharge lamp comprising an outer bulb enclosing a single discharge vessel including an ionizable material comprising a metal halide capable of sustaining an arc; and electrodes connected to current conductors, said lamp having a frame wire structure which comprises two frame wires, each conducting one-half of a total current supplied to said single discharge vessel, each being spirally curved around said single discharge vessel in a direction oriented substantially parallel to the longitudinal axis of said single discharge vessel, and connected to one of said current conductors, and extending between said single discharge vessel and said outer bulb, said wire structure being effective to substantially eliminate arc bending, regardless of the orientation of the lamp during operation in a fixture.

8. A discharge lamp as claimed in claim 7, wherein at least one of said two frame wires spirally curve with at least one revolution.

9. A lamp as claimed in claim 8, wherein the distance between the single discharge vessel and each of said two frame wires is substantially equal.

10. A lamp as claimed in claim 7, having a power range of about 150 W to about 1000 W and exhibiting one or more of a characteristic selected from the group consisting of a CCT (correlated color temperature) of about 3800 to about 4500K, a CRI (color rendering index) of about 85 to about 95, a MPCD (mean perceptible color difference) of about ±10, and a luminous efficacy up to about 85–95 lumens/watt.

11. A lamp as claimed in claim 8, further comprising ballasts designed for high pressure sodium or quartz metal halide lamps.

12. A discharge lamp as claimed in claim 7, wherein said two frame wires commonly contact a dimple formed in the upper axial end of the single discharge vessel.

13. A discharge lamp comprising an outer bulb enclosing one cylindrical ceramic discharge vessel, said cylindrical ceramic discharge vessel enclosing a discharge space and including within said discharge space an ionizable material comprising a metal halide capable of sustaining an arc; a first and second discharge electrode feedthrough means; and a first and second current conductors connected to said first and second discharge electrode feedthrough means, through connectors respectively;

said lamp having a frame wire structure which comprises two spirally curved frame wires, each being spirally curved around said ceramic discharge vessel in a direction oriented substantially parallel to the longitudinal axis of said discharge vessel, and connected to one of said current conductors through a connector, and each conducting one-half of a total current to said ceramic discharge vessel, and extending between said ceramic discharge vessel and said outer bulb, said wire structure being effective to substantially eliminate arc bending, regardless of the orientation of the lamp during operation in a fixture.

14. A lamp as claimed in claim 13, wherein the distance between the center of the ceramic discharge vessel and the two spiraling curved frame wires is substantially equal in all directions.

15. A lamp as claimed in claim 13, having a power range of about 150 W to about 1000 W and exhibiting one or more of a characteristic selected from the group consisting of a CCT (correlated color temperature) of about 3800 to about 4500K, a CRI (color rendering index) of about 85 to about 95, a MPCD (mean perceptible color difference) of about −10, and a luminous efficacy up to about 85–95 lumens/watt.

16. A lamp as claimed in claim 13, further comprising ballasts designed for high pressure sodium or quartz metal halide lamps.

17. A discharge lamp as claimed in claim 13, wherein said two spirally curved frame wires are spirally curved with at least one revolution.

18. A discharge lamp as claimed in claim 13, therein said two frame wires commonly contact a dimple formed in the upper axial end of the single discharge vessel.

19. A discharge lamp comprising an outer bulb enclosing one cylindrical ceramic discharge vessel, said cylindrical ceramic discharge vessel enclosing a discharge space and including within said discharge space an ionizable material comprising a metal halide capable of sustaining an arc; a first and second discharge electrode feedthrough means; and a first and second current conductors connected to said first and second discharge electrode feedthrough means respectively;

said lamp having a frame wire structure which comprises two frame wires being spirally curved around said discharge vessel and connected to said current conductors, extending between said ceramic discharge vessel and said outer bulb, each of said frame wires conducting one-half of a total current to said cylindrical ceramic discharge vessel, said frame wires extending approximately parallel to and approximately equidistant from the discharge vessel and effective to reduce arc bending regardless of the orientation of the lamp during operation in a fixture and having a power range of about 150 W to about 1000 W and exhibiting one or more of a characteristic selected from the group consisting of a CCT (correlated color temperature) of about 3800 to about 4500K, a CRI (color rendering index) of about 85 to about 95, a MPCD (mean perceptible color difference) of about ±10, and a luminous efficacy up to about 85–95 lumens/watt.

20. A discharge lamp as claimed in claim 19, wherein said two frame wires are spirally curved with at least one revolution.

21. A discharge lamp as claimed in claim 19, wherein said two frame wires commonly contact a dimple formed in the upper axial end of the single discharge vessel.

22. A discharge lamp comprising an outer bulb enclosing a discharge vessel, said discharge vessel enclosing a discharge space and including within said discharge space an ionizable material comprising a metal halide capable of sustaining an arc; and electrodes connected to current conductors; said lamp having a frame wire structure which comprises two frame wires being spirally curved around said discharge vessel in a direction oriented substantially parallel to the longitudinal axis of said discharge vessel, and connected to said current conductors, said frame wires being effective to reduce arc bending.

* * * * *